United States Patent [19]

Morrice et al.

[11] 4,135,921

[45] Jan. 23, 1979

[54] PROCESS FOR THE PREPARATION OF RARE-EARTH-SILICON ALLOYS

[75] Inventors: Edward Morrice; Jack D. Marchant, both of Reno, Nev.

[73] Assignee: The United States of America as represented by the Secretary of the Interior, Washington, D.C.

[21] Appl. No.: 884,324

[22] Filed: Mar. 7, 1978

[51] Int. Cl.[2] ..... C21C 7/00; C22C 33/04; C22C 38/00

[52] U.S. Cl. ..... 75/134 N; 75/134 S; 75/152

[58] Field of Search ..... 75/152, 53–58, 75/134 N, 134 S

[56] References Cited

U.S. PATENT DOCUMENTS

| | | | |
|---|---|---|---|
| 2,926,080 | 2/1960 | Motz et al. | 75/27 |
| 3,264,093 | 8/1966 | Sump | 75/10 |
| 3,537,844 | 11/1970 | Hirschhorn et al. | 75/84 |
| 3,802,865 | 4/1974 | Ohrubo et al. | 75/30 |
| 3,953,579 | 4/1976 | Herchenroeder | 75/152 |
| 4,018,597 | 4/1977 | Staggers | 75/58 |

OTHER PUBLICATIONS

Perri et al., "Rare Earth Metal Disilicides" J. Phys. Chem. 63 (1959) 616.

*Primary Examiner*—L. Dewayne Rutledge
*Assistant Examiner*—Upendra Roy
*Attorney, Agent, or Firm*—William S. Brown; Donald A. Gardiner

[57] ABSTRACT

A method for the production of a rare-earth-silicon alloy useful as an additive in the production of various ferrous metals. The process comprises the bringing together and reaction of one or more rare-earth metal compounds, an elemental silicon source and an elemental aluminum source in the presence of calcium oxide. High recoveries of the rare-earth metals are found, little rare-earth metal being lost to the slag produced from the reaction.

11 Claims, No Drawings

PROCESS FOR THE PREPARATION OF RARE-EARTH-SILICON ALLOYS

BACKGROUND OF THE INVENTION

Rare-earth-silicon alloys or these alloys further comprising iron are used in the iron and steel industry for deoxidation, desulfurization, sulfide shape control and grain refinement, thereby producing improved properties in the products. Additionally, the rare-earth metal ore can be used in such additions as described in U.S. Pat. No. 3,065,070.

The preparation of rare-earth metal alloys is described in U.S. Pat. Nos. 3,250,609, 3,537,844, 2,926,080, 3,264,093 and 3,256,087, as well as in German Pat. Nos. 1,800,701 and 1,274,801.

A more recent description of the rare-earth metal silicide alloys is found in U.S. Pat. No. 4,018,597. The method described therein is a carbothermic reducing reaction between a rare-earth metal compound, silica and iron at temperatures in excess of about 3500° F. (at least about 1926° C.). However, the rare-earth metal recovery, as in other commerical smelting operations, may be less than 60%, and the rare-earth content of the product may only be about 30%.

Attempts to utilize silicon or ferrosilicon as the reductant were not totally successful since alloy products were obtained having 36% and 33% by weight rare-earth, respectively. Thus, these, as well as prior art methods, indicated that existing technology could not easily provide for the production of rare-earth-silicon alloys having high rare-earth contents, nor could the processes result in satisfactorily high net recoveries of the rare-earth values charged, the remainder being lost in the slag produced.

It is therefore an object of the present invention to provide a process for the production of a rare-earth-silicon alloy, which may additionally contain iron and other ingredients, which has a high rare-earth metal content.

An additional object of the present invention is a process for the production of a rare-earth-silicon alloy which is efficient to the extent of incorporating a large percentage of the charged rare-earth value into the alloy product.

A further object of the present invention is a process for the production of a rare-earth-silicon alloy which utilizes relatively low reaction temperatures and is readily adaptable to various reactors.

A still further object of the present invention is a rare-earth-silicon alloy which has a minor amount of aluminum, thereby increasing its value as a steel additive, and a high percentage of rare-earth metal.

SUMMARY OF THE INVENTION

In one aspect of the present invention, a process is provided whereby a rare-earth metal source, such as an ore, is reacted with a silicon source, such as silicon or ferrosilicon, and aluminum as a further reductant in the presence of calcium oxide. It has been found that the excellent reducing power of the aluminum combined with the effect of the calcium oxide slag-former results in a rare-earth-silicon alloy having a high content of rare-earth metal, while the alloy itself has a very high percentage of the rare-earth values charged. Thus, a concentrated product is produced with small losses of the valuable rare-earth metals. The reaction can be conducted at about 1450°–1700° C., and the charged materials may further include magnesium oxide, alumina and silicon dioxide as well as other materials.

DETAILED DESCRIPTION OF THE INVENTION

The rare-earth metals are those elements of Atomic Nos. 57–71 and further including yttrium of Atomic No. 39. The rare-earth metal compounds which can be used in the present invention include the oxides, carbonates and fluorocarbonates as well as other compounds. Preferred in terms of availability and cost for use as the rare-earth metal reactants in the present invention are the monazite and bastnasite ores found in the Western United States. However, pure compounds, such as cerium oxide, can be used in the present invention. Further, the ores per se or their concentrates may be used. These may have at least about 55–60% and up to as much as 85–90% rare-earth metal oxides and about 10–15% of other metal oxides, including calcium, barium and strontium oxides. Preferred rare-earth metal sources are the monazite and bastnasite ores containing about 55–90% by weight rare-earth metal oxides. However, commercially available raw and treated bastnasite concentrates can be used containing 62 and 92% by weight rare-earth metal oxides, respectively.

Silicon is utilized in the form of elemental silicon, as ferrosilicon alloy or in the form of silicon-aluminum alloy, whereby the aluminum requirement of the reaction can also be satisfied. Further, calcium silicide could be used, but its availability varies and it is thus not a preferred component. Ferrosilicon alloys are commercially available in Fe:Si weight ratios of 30:70, 50:50 and 25:75. Any of these may be used if the calculated amount of silicon required is sufficiently provided as indicated below with respect to a method for calculating the amounts of the components. Aluminum-silicon alloys may be used, and this is generally commercially available in a 50:50 weight ratio.

Aluminum may be used in the form of aluminum turnings or scrap aluminum containing 99.5% by weight aluminum. However, a wide variety of elemental aluminum sources can be used as long as the amount added is in accordance with the calculations indicated below.

Calcium oxide is used in the present invention after it was observed that slags containing lower rare-earth content could be obtained if calcium oxides were used in the flux. The lower rare-earth content in the slag meant that higher rare-earth values were incorporated into the alloy product.

Further with respect to the importance of the calcium oxide, it was observed that rare-earth alloys prepared from bastnasite sources would disintegrate into powder on standing in air for relatively short periods of time — e.g., less than 48 hours — if less than 16% by weight calcium oxide was in the slag produced. Rare-earth-silicon alloys in powder form are considered by the steel industry to be undesirable as ladle additives. Disintegration of alloy products could be caused by absorption of moisture from the air and subsequent hydrolysis of metal phosphides present to give off phosphine ($PH_3$). It was determined that phosphorus is present in gases given off by alloys prepared using low calcium oxide slags. Since slags high in calcium oxide content have the possibility of dephosphorizing the alloy products, it is believed that the calcium oxide in the present invention serves a dual purpose of increasing rare-earth recovery into the product alloy and preventing disintegration of the product itself.

Calcium oxide may be used in the present invention in technical grade form. The amount of calcium oxide added should be that needed to obtain a slag containing from about 54–56% by weight calcium oxide. The basic reaction equation dictates the amount of silicon dioxide and alumina produced, and since this is the basic constituent of the slag when the rare-earth metal oxide, silicon and aluminum are reacted, one may calculate the amount of calcium oxide required to give this weight range of calcium oxide in the slag. This amount of calcium oxide is generally added in order to avoid a high-melting, aluminum oxide-silicon dioxide-calcium oxide slag.

Calcium oxide as a component in a slag-forming agent is described in U.S. Pat. No. 3,802,865 in the manufacture of steel.

Magnesium oxide may be added in order to increase fluidity of the reaction mixture at temperatures as low as about 1450° C. The magnesium oxide may be used in technical grade form and is generally added in an amount of from about 4–5% by weight of the slag produced by the method of calculation indicated above for the calcium oxide.

Additional components in the reaction mixture may be aluminum oxide and silicon dioxide which would be used in order to obtain the desired slag composition.

Calculations as to the amount of each of the components to be added are controlled by the following equation:

$$3RE_2O_3 + 15Si + 2Al \rightarrow 6RESi_2 + 3SiO_2 + Al_2O_3$$

As can be seen above, the iron does not enter into the reaction, and thus, if ferrosilicon alloy is used as the silicon source, the weight percentage of silicon therein must be known in order that the calculation can be made.

In order to begin the calculation, the content of rare-earth metal oxides or other compounds of rare-earth metals in the source is determined. Taking the average molecular weight of rare-earth metal as it is found in nature as being 140, the rare-earth metal oxide, if such ores are used, is thus calculated to have a molecular weight of about 328. From this, the number of moles of $RE_2O_3$ in the amount of ore chosen to be reacted is calculated. From this, one figures the number of moles of silicon needed as being five times the number of $RE_2O_3$ moles present, and this is reduced to the number of grams of silicon or number of grams of silicon alloy which is to be used as the silicon source. In this manner also, one calculates that two-thirds the number of $RE_2O_3$ moles to be the number of moles of aluminum needed, and this is also figured in terms of the number of grams required.

Further from this equation, and knowledge of the rare-earth metal value of the ore, the weight of slag that will be produced by the reaction in question is figured. From this, the amount of calcium oxide or calcium oxide and magnesium oxide is calculated to be that needed to obtain a slag containing about 54–56% by weight calcium oxide and from about 4–5% by weight magnesium oxide. These figures may be adjusted somewhat depending upon the character of the rare-earth metal source as well as other factors.

It should be noted that the above equation, while representative of the reaction taking place, need not be strictly observed in terms of molar proportions utilized. Thus, experimentation has shown that better recovery of rare-earth values was obtained by utilizing up to about 1.2 times the amount of silicon and up to about 7 times the amount of aluminum calculated from the equation, ultimately being based upon the actual weight of rare-earth oxide in the charge. Thus, the molar ratio can be from about $3RE_2O_3$:≧15 Si:≧2 Al up to about $3RE_2O_3$:18 Si:14 Al.

Calculating the amount of silicon and aluminum needed for one pound of pure $RE_2O_3$ would proceed as follows:

$$\text{lbs Si} = \frac{1\text{ lb Si}}{454\text{g Si}} \times \frac{28\text{g Si}}{\text{M Si}} \times \frac{15\text{M Si}}{3\text{M } RE_2O_3} \times \frac{1\text{M } RE_2O_3}{328\text{g } RE_2O_3} \times 454\text{g } RE_2O_3 = 0.43$$

$$\text{lbs Al} = \frac{1\text{ lb Al}}{454\text{g Al}} \times \frac{27\text{g Al}}{\text{M Al}} \times \frac{2\text{M Al}}{3\text{M } RE_2O_3} \times \frac{1\text{M } RE_2O_3}{328\text{g } RE_2O_3} \times 454\text{g } RE_2O_3 = 0.555$$

The temperature of the reaction may be from about 1450°–1700° C. At operating temperatures below about 1400° C., the slag is viscous, making pouring and alloy-slag separation difficult. At temperatures above about 1700° C., there is fuming, and furnace materials give poor service.

The reactor for the process may be any suitable reactor capable of generating and maintaining the reaction temperature. Containers for the reactants may be crucibles of silicon carbides, boron nitride or graphite. When graphite is used, some calcium carbide may be produced. An induction furnace is advantageously used as the heat source.

Reaction time can vary from about 15–45 minutes at the selected temperature.

All components charged to the reactor should advantageously be in particular form. Thus, the rare-earth ore may be in powder form, the ferrosilicon alloy in the form of fragments, the aluminum in the form of turnings and the calcium and magnesium oxides in the form of powder. Preferably, the ferrosilicon alloy is in the form of fragments having a size of ¼ inch or less. The alumunim can also be in the form of cuttings or ingots.

After the charge is melted in the reaction crucible and held at the desired temperature for the time period required for completion of the reaction, the melt is poured or tapped into molds. Separation of the reaction products can be accomplished by either pouring the alloy and slag into separate molds or by allowing the melt to freeze, followed by breaking the slag away from the alloy product.

The invention thus allows the production of rare-earth-silicon alloys having at least about 45% by weight rare-earth metal and at least about 27% silicon. In more detail, the alloy may contain from about 45–55% by weight rare-earth metal, about 27–30% by weight silicon, about 8–16% by weight iron, about 2–4% by weight aluminum, about 2–5% by weight calcium, less than about 1% by weight barium, and less than about 1% by weight strontium.

A typical alloy product produced by the process of the present invention had the following analysis:

| RE metal | Si | Analysis (in weight %) Fe | Al | Sr | Ba | Ca |
|---|---|---|---|---|---|---|
| 54.5 | 27.4 | 10.6 | 3.9 | <1 | <1 | 5.0 |

In contrast to the above, a prior process such as that described in U.S. Pat. No. 4,018,597 indicates an alloy with up to only about 40% by weight rare-earth metal.

The slag produced by the process of the present invention will generally contain from about 54–56% by weight calcium oxide and about 4–5% by weight magnesium oxide.

Utilization of the rare-earth-silicon alloys of the present invention may be as described in the article entitled "Rare-Earth Additions to Electric Furnace Steels for Sulfide Shape Control," by Howard W. Bennett and Lawrence P. Sandell, Jr., in the Journal of Metals, February 1974, pages 21–24; in the report entitled "Effects of Adding Rare-Earth Silicides, Aluminum, and Cryolite to Molten Steel," by R. J. Leary, R. T. Couleman, H. A. Tucker and W. G. Wilson, Report No. RI7091 of the Bureau of Mines, U.S. Department of the Interior, March 1968; and in the report entitled "Rare Earths Supply Ample in 1975, New Markets Promise Continued Growth Demand," by Joseph G. Cannon, in Engineering and Mining Journal, Volume 177, No. 3, March 1976, pages 184–189.

The following example illustrates the process of the present invention but is not to be construed as limiting.

EXAMPLE 1

Ferrosilicon alloy, having 25% by weight iron, in an amount of 132 grams, rare-earth oxide ore, having 82.5% by weight $RE_2O_3$, in an amount of 227 grams, aluminum metal in an amount of 68.5 grams, calcium oxide in an amount of 263 grams, and magnesium oxide in an amount of 24 grams were placed in a silicon carbide crucible in an induction furnace.

The charge was then heated to 1600° C. and the melt was maintained at this temperature for 30 minutes.

After completion of the reaction, the melt was then poured into a conical mold and allowed to freeze.

After solidification, the slag was broken away from the product and both were analyzed utilizing chemical and instrumental techniques.

The alloy product had the following composition:

| | Weight % |
|---|---|
| Rare-Earth Metals | 46.0 |
| Silicon | 46.0 |
| Iron | 8.9 |
| Aluminum | 3.2 |

Further, the slag was found to only contain 4.5% by weight rare-earth metals, while the rare-earth metal content of the alloy product was found to contain 91.5% of the rare-earth metals charged originally. The alloy product contained about 0.05% by weight of phosphorus and did not break up into fragments or powder upon standing in air.

It can thus be seen that the present invention has distinct advantages over the current industrial method of smelting in a submerged carbon arc furnace using a charge consisting of mixed rare-earth oxides, iron scrap, coke and silica pebbles. Net recovery of rare-earth metals in the alloy product as compared with that amount charged is over 85% by weight as compared to recoveries of less than 60% by weight using conventional methods.

While the invention has been described in detail and with reference to specific embodiments thereof, it will be apparent to one skilled in the art that various changes and modifications can be made therein without departing from the spirit and scope thereof.

What is claimed is:

1. A method for the production of a rare-earth-silicon alloy comprising reacting the components:

(a) one or more rare-earth metal compounds;

(b) an elemental silicon source; and (c) an elemental aluminum source, in the presence of calcium oxide.

2. The method of claim 1 wherein said reacting is at a temperature of about 1450°–1700° C.

3. The method of claim 1 wherein said component (a) is monazite or bastnasite ore.

4. The method of claim 1 wherein said component (b) is elemental silicon or a ferrosilicon alloy having about 25–50% by weight iron.

5. The method of claim 1 wherein said components (b) and (c) are an aluminum-silicon alloy.

6. The method of claim 1 wherein said rare-earth-silicon alloy comprises at least about 45% by weight rare-earth metal and at least about 27% silicon.

7. The method of claim 6 wherein said rare-earth-silicon alloy comprises about 45–55% by weight rare-earth metal, about 27–30% by weight silicon, about 10–16% by weight iron, about 2–5% by weight aluminum, about 2–5% by weight calcium, less than about 1% by weight barium, and less than about 1% by weight strontium.

8. The product produced by the process of claim 7.

9. The method of claim 3 wherein said reaction is conducted with the components present in the molar ratio of $3RE_2O_3$:≧15 Si:≧2 Al, wherein $RE_2O_3$ is rare-earth oxide, and the calcium oxide is present in an amount sufficient to constitute about 54–56% by weight of the slag produced by the reaction which further comprises $SiO_2$ and $Al_2O_3$.

10. The method of claim 9 wherein said molar ratio is about $3RE_2O_3$:18 Si:14 Al.

11. The method of claim 9 wherein said reaction is further in the presence of MgO in an amount sufficient to constitute about 4–5% by weight of the slag.

* * * * *